United States Patent [19]

Faure

[11] Patent Number: 4,963,322

[45] Date of Patent: Oct. 16, 1990

[54] PROCESS FOR THE PRODUCTION OF GOOD FATIGUE STRENGTH ALUMINUM ALLOY COMPONENTS

[75] Inventor: Jean-François Faure, Voiron, France

[73] Assignee: Pechiney Recherche Groupement d'Interet Economique, Paris, France

[21] Appl. No.: 409,694

[22] Filed: Sep. 20, 1989

[30] Foreign Application Priority Data

Sep. 26, 1988 [FR] France ..... 88 12982

[51] Int. Cl.[5] ..... B22F 4/00

[52] U.S. Cl. ..... 419/33; 419/23; 75/249; 420/516; 420/518

[58] Field of Search ..... 419/23, 33; 75/249; 420/516, 518

[56] References Cited

U.S. PATENT DOCUMENTS

| | | | |
|---|---|---|---|
| 3,899,820 | 8/1975 | Read et al. | 29/420.5 |
| 4,347,076 | 8/1982 | Ray et al. | 75/249 |
| 4,592,781 | 6/1986 | Cheney et al. | 75/249 |
| 4,647,321 | 3/1987 | Adam | 75/249 |
| 4,676,830 | 6/1987 | Inumaru et al. | 75/249 |
| 4,732,610 | 3/1988 | Hildeman et al. | 75/249 |
| 4,737,339 | 4/1988 | Couper | 419/23 |

*Primary Examiner*—Stephen J. Lechert, Jr.

*Attorney, Agent, or Firm*—Dennison, Meserole, Pollack & Scheiner

[57] ABSTRACT

The invention relates to a process for the production of aluminum alloy components retaining a good fatigue strength when used hot.

This process consists of producing an alloy containing by weight 11 to 26% silicon, 2 to 5% iron, 0.5 to 5% copper, 0.1 to 2% magnesium, 0.1 to 0.4% zirconium and 0.5 to 1.5% manganese, subjecting the alloy in the molten state to a fast solidification means, bringing it into the form of parts or components and optionally subjecting the latter to a heat treatment at between 490° and 520° C., followed by water hardening and annealing at between 170° and 210° C.

These components are used more particularly as rods, piston rods and pistons.

6 Claims, No Drawings

PROCESS FOR THE PRODUCTION OF GOOD FATIGUE STRENGTH ALUMINUM ALLOY COMPONENTS

The present invention relates to a process for the production of components made from aluminum alloy retaining good fatigue strength after being kept hot for a long time.

It is known that aluminum is three times lighter than steel and has a good corrosion resistance. By alloying it with metals such as copper and magnesium, its mechanical strength is considerably improved. Furthermore, the addition of silicon gives a product with a good resistance to wear. These alloys doped with other elements such as iron, nickel, cobalt, chrome and manganese acquire improved characteristics when hot. A compromise between these addition elements means that aluminum is very advantageous for the production of car components, such as engine blocks, pistons, cylinders, etc.

Thus, EP-A-144 teaches an aluminum alloy containing by weight 10 to 36% silicon, 1 to 12% copper, 0.1 to 3% magnesium and 2 to 10% of at least one element chosen from the group Fe, Ni, Co, Cr and Mn.

This alloy can be used in the production of parts intended both for the aeronautical and car industries, said parts being obtained by powder metallurgy which, apart from shaping by compacting and drawing, involves an intermediate heat treatment stage at between 250° and 550° C. Although these parts or components satisfy the properties indicated hereinbefore, no account is taken in this connection of the fatigue strength.

The Expert knows that fatigue corresponds to a permanent, local and progressive change to the metal structure occurring in materials subject to a succession of discontinuous stresses and which can lead to cracks and even breakages to the components following an application of said stresses in a varying number of cycles, this being the case when their intensity is usually well below that which it is necessary to apply to the material in a continuous manner in order to obtain a tensile break or fracture. Thus, the values given for the modulus of elasticity, tensile strength and hardness given in EP-A-144 898 do not take account of the fatigue strength of the alloy.

However, it is important for parts such as rods or piston rods, which are dynamically stressed and which are subject to periodic stresses and forces, to have a good fatigue strength.

Thus, on considering this problem, the Applicant has found that although components made from alloys falling within the scope of the aforementioned document has a fatigue strength which could be adequate for certain applications, said property could be significantly improved by modifying the composition thereof. The Applicant has therefore developed parts or components made from aluminum alloys containing by weight 11 to 22% silicon, 2 to 5%, iron, 0.5 to 4% copper, 0.2 to 1.5% magnesium and which are characterized in that they also contain 0.4 to 1.5% zirconium. This invention has also formed the subject matter of French patent application 87-17674 and corresponding U.S. application Ser. No. 07/275,506, now U.S. Pat. No. 4,923,676.

However, the Applicant has found that although zirconium led to a significant improvement from the stress limit standpoint at 20° C., because it increased from 150 to 185 MPa, after keeping at 150° C. for 1000 hours (which roughly represents the working conditions of a rod after half the life of an engine), said limit dropped to 143 MPa, i.e. a reduction of more than 22%.

However, on continuing the research, the Applicant found that this disadvantage could be obviated by combining the action of manganese with that of zirconium. Therefore the present invention relates to a process for the production of aluminum alloy components retaining a good fatigue strength after being kept hot for a long period and containing by weight 11 to 26% silicon, 2 to 5% iron, 0.5 to 5% copper, 0.1 to 2% magnesium and optionally minor additions of nickel and/or cobalt and which are characterized in that they also contain 0.1 to 0.4% zirconium and 0.5 to 1.5% manganese.

These ranges cover zirconium and manganese addition values below which the effect is not significant and above which either the zirconium addition no longer has a determinative influence, or the manganese addition leads to an embrittlement of the component and to a drop in the stress limit of a notched or slotted component, i.e. having surface irregularities such as screw threads, fillets, etc.

Thus, compared with the composition described in the aforementioned patent application, manganese has been substituted for part of the zirconium, which on the other hand permits an economy as regards to the starting materials, because manganese is less expensive than zirconium and on the other hand facilitate the alloy melting conditions, because a binary alloy containing 1% zirconium has a liquidus temperature of 875° C., whereas this temperature remains close to 660° C. in the case of 1% manganese.

However, apart from the particular composition of the alloy used, the invention is also characterized in that in the molten state the alloy is subject to a fast solidification means before producing components therefrom. Thus, as the elements such as iron, zirconium and manganese are only very slightly soluble in the alloy, in order to obtain components having the desired characteristics, it is vital to avoid a rough, heterogeneous precipitation of said elements, which is brought about by cooling them as fast as possible. Moreover, the alloy is preferably melted at a temperature above 700° C., so as to prevent any premature precipitation phenomenon.

There are several ways to obtain this fast solidification:

(1) The molten alloy is brought into the form of fine droplets either by atomizing the molten metal with the aid of a gas, or by mechanical atomization followed by cooling in a gas (air, helium, argon), or by centrifugal atomization, or some related process. This leads to powders with a grain size below 400 μm, which are then, in accordance with well known powder metallurgy methods, shaped by hot or cold compacting in a uniaxial or isostatic press, followed by drawing and/or forging.

(2) The molten alloy is projected against a cooled metal surface, e.g. by melt spinning or planar flow casting and which are described in U.S. Pat. No. 4,389,258 and European patent 136,508, or by melt overflow and related methods. This gives strips with a thickness below 100 μm, which are then shaped in the above manner.

(3) The atomized molten alloy in a gas flow is projected against a substrate, e.g. in accordance with the spray deposition or spray casting methods described in British patent 1,379,261 and leading to a coherent deposit, which is sufficiently malleable in order to be shaped by forging, drawing or dying.

Obviously this list is not exhaustive.

In order to further inprove the precipitation structure, after optionally undergoing machining the components are thermally treated at between 490° and 520° C. for 1 to 10 hours, followed by water hardening. They then undergo annealing at between 170° C. and 210° C. for 2 to 32 hours, which improves their mechanical characteristics.

The invention will be better understood as a result of studying the following application examples. A base alloy material containing by weight 18% silicon, 3% iron, 1% copper, 1% magnesium and the remainder aluminum was melted at about 900° C. and then divided up into 8 batches numbered 0 to 7. To batches 1 to 7 were added different zirconium and manganese quantities, batch 0 serving as a control.

the same measurement as hereinbefore, but after keeping the testpiece at 150° C. for 1000 hours;

the endurance ratio Lf/Rm at 20° C.;

The stress limit at 20° C., as hereinbefore, but on a notched testpiece with Kt=2.2;

the sensitivity coefficient to notching $$q = \frac{Kf - 1}{Kt - 1}$$

in which Kf is the ratio of the stress limit measured on the smooth testpiece to the stree limit on the notched testpiece (the higher q, the more sensitive the alloy to notching).

All the results of these measurements appear in the following table.

Base alloy Si 18%, Fe 3%, Cu 1%, Mg 1%, remainder Al

| All. | Process | wt % addition | | modulus of elasticity | Tension at 20° C. | | | Tension at 150° C. after keeping for 100 h | | |
|---|---|---|---|---|---|---|---|---|---|---|
| No. | * | Zr | Mn | E(GPa) | Ro,2(MPa) | Rm(MPa) | A % | RO,2(MPa) | Rm(MPa) | A % |
| 2 | SD | 0.8 | 0.3 | 89 | 395 | 465 | 3.2 | 322 | 392 | 6.0 |
| 1 | PM | 1.0 | 0.0 | 91 | 390 | 460 | 3.0 | 320 | 390 | 6.0 |
| 5 | PM | 0.2 | 1.2 | 92 | 415 | 475 | 3.0 | 340 | 400 | 6.0 |
| 4 | SD | 0.4 | 0.6 | 90 | 418 | 470 | 3.2 | 335 | 397 | 6.5 |
| 3 | SD | 0.1 | 0.6 | 88 | 412 | 468 | 3.3 | 330 | 392 | 6.7 |
| 6 | PM | 0.1 | 1.4 | 92 | 410 | 477 | 2.8 | 342 | 405 | 5.8 |
| 0 | PM | 0.0 | 0.0 | 87 | 350 | 430 | 2.5 | 290 | 385 | 5.0 |
| 7 | SD | 1.0 | 1.0 | 93 | 400 | 470 | 1.0 | 328 | 392 | 3.0 |

*SD: spray deposition
PM: powder metallurgy

| No. | Stress limit, $10^7$ cycles at 20° C. - state T6, smooth Lf (MPa) | Endurance ratio Lf/Rm | Stress limit, $10^7$ cycles at 20° C. - State T6, smooth after 1000 h at 150° C. (MPa) | Stress limit, $10^7$ cycles at 20° C. - state T6, notched Kt = 2.2 (MPa) | $q = \frac{kf - 1}{Kt - 1}$ |
|---|---|---|---|---|---|
| 2 | 186 | 0.4 | 148 | 110 | 0.58 |
| 1 | 185 | 0.4 | 143 | 108 | 0.59 |
| 5 | 193 | 0.4 | 177 | 120 | 0.51 |
| 4 | 192 | 0.4 | 170 | 122 | 0.48 |
| 3 | 190 | 0.4 | 168 | 125 | 0.43 |
| 6 | 195 | 0.4 | 175 | 121 | 0.51 |
| 0 | 150 | 0.35 | 120 | 92 | 0.53 |
| 7 | 180 | 0.38 | 140 | 105 | 0.60 |

These batches were treated either by powder metallurgy, or by spray deposition:

powder metallurgy (PM) comprises atomization in a nitrogen atmosphere of particles with a grain size below 200 μm, followed by compacting under 300 MPa in an isostatic press, followed by drawing into the form of 40 mm diameter bars;

spray deposition uses the procedure of British patent 1,379,261 and makes it possible to obtain a deposit in the form of a cylindrical billet, which is then transformed into a 40 mm bar by drawing.

These parts are then treated for 2 hours at between 490° and 520° C., followed by water hardening and exposure to a temperature of 170° to 200° C. for 8 hours.

On testpieces of each of these parts, measurements took place in known manner of the following characteristics:

modulus of elasticity E in GPa, the conventional elastic limit at 0.2%: RO,2 in MPa, the breaking load Rm in MPa, the elongation A as a %; said measurements being performed at 20° C. and then 150° C. after maintaining for 100 hours;

the stress limit at 20° C. after $10^7$ cycles, Lf in MPa, on smooth testpieces instate T6 according to the aluminum association standards and stressed by rotary bending;

It is apparent from these measurements that if after keeping for 1000 hours at 150° C. the stress limit is 120 MPa for an alloy containing neither zirconium, nor manganese (No. 0), the addition of 1% zirconium, (No. 1) passes this characteristic to 148 MPa and the simultaneous addition of zirconium and manganese with a reduced zirconium quantity (No. 5) makes it possible to obtain a value of 177 MPa.

Moreover, the simultaneous presence of zirconium and manganese makes it possible to significantly reduce the deterioration to the stress limit occurring after keeping at 150° C. Thus, with alloy No. 1 without manganese, the Lf passes from 185 to 143 MPa, i.e. a deterioration of 42 MPa, whereas in the case of alloy No. 5 containing 1.2% manganese, the Lf passes from 193 to 177 MPa, i.e. a deterioration of 16 MPa, which is much lower than the previous value.

The measurements also show that the elements improve the stress limit on notched parts, but their presence in excessive quantities contributes to the deterioration of this characteristic and to an increase in brittleness. Thus, the value of said limit passes from 100 MPa for testpiece No. 0 to 125 MPa for testpiece No. 3 (0.1% Zr-0.6% Mn), but drops to 105 MPa for testpiece No. 7 containing more zirconium and manganese.

Thus, the simultaneous presence of zirconium and manganese in the proportions according to the invention (alloys 5, 4, 3 and 6) leads to a lower notching sensitivity coefficient (0.51, 0.48, 0.43 0.51) than for the prior art alloys with the coefficient close to 0.6, apart from alloy No. 0, which is unusable due to its inadequate mechanical strength.

Thus, according to the invention, the combination of zirconium and manganese in limited quantities and the fast solidification of the alloy obtained contribute to improving the fatigue strength, no matter whether in the hot or cold state, of parts or components liable to have surface irregularities, such as screw threads or fillets and which are used in the car industry, particularly in the production of rods, piston rods and pistons.

I claim:

1. Process for the production of aluminum alloy components retaining a good fatigue strength after being kept hot for a long time, containing by weight 11 to 26% silicon, 2 to 5% iron, 0.5 to 5% copper, 0.1 to 2% magnesium and up to minor additions of nickel and/or cobalt, wherein said alloy also contains 0.1 to 0.4% zirconium and 0.5 to 1.5% manganese: comprising the steps of atomizing the alloy in the molten state and subjecting it to a fast solidification; and shaping the product obtained into the components of at least about 148 MPa.

2. Process according to claim 1, wherein the fast solidification step consists of dividing the molten alloy into the form of fine droplets.

3. Process according to claim 1, wherein the fast solidification step consists of projecting the molten alloy against a cooled metal surface.

4. Process according to claim 1, wherein the fast solidification step consists of projecting the molten alloy in a gas flow against a substrate.

5. Process according to claim 1, wherein the components undergo additional steps comprising a heat treatment at a temperature between 490° and 520° C., water hardening and annealing at between 170° and 210° C.

6. Process according to claim 1, wherein the fatigue strength of at least 148 MPa is obtained after the alloy is kept for about 1000 hours at about 150° C.

* * * * *